US005226246A

United States Patent [19]

Soo

[11] Patent Number: 5,226,246

[45] Date of Patent: Jul. 13, 1993

[54] MEANS FOR CONVERTING UNFINISHED PRODUCTS OF LACE-TYPE SKATES INTO BUCKLE-TYPE SKATES

[76] Inventor: Mike Soo, No. 403, Chungshan Rd., Jenteh Hsiang, Tainan Hsien, Taiwan

[21] Appl. No.: 761,329

[22] Filed: Sep. 17, 1991

[51] Int. Cl.[5] ..... A43C 11/00; A43C 11/12

[52] U.S. Cl. ..... 36/50.1; 36/136; 36/50.5; 12/113

[58] Field of Search ..... 36/50, 136; 12/113

[56] References Cited

U.S. PATENT DOCUMENTS

| | | | |
|---|---|---|---|
| 628,777 | 7/1899 | Durkee | 12/113 |
| 1,052,169 | 2/1913 | Papp | 36/50.1 |
| 1,694,101 | 12/1928 | McClure | 36/50 |
| 2,215,221 | 9/1940 | Levine | 36/50 |
| 3,600,761 | 8/1971 | Mathey | 36/50 |
| 4,907,352 | 3/1990 | Ginsberg | 36/50 |

FOREIGN PATENT DOCUMENTS

| | | | |
|---|---|---|---|
| 258287 | 5/1949 | Switzerland | 36/50 |

*Primary Examiner*—Steven N. Meyers
*Assistant Examiner*—M. D. Patterson
*Attorney, Agent, or Firm*—Wolf, Greenfield & Sacks

[57] ABSTRACT

A converting plate for converting an unfinished product of a skate of lace-type into buckle-type includes an upper side and an underside with a contour complimentary to that of an upper surface of the lace-type skate. A number of protrusions are formed on the underside of the converting plate corresponding to eyelets of the lace-type skate. A number of pairs of flanges are formed on the upper side of the converting plate, defining a space between each pair of flanges for installing a buckle. A number of mounting holes are formed on the converting plate for securely mounting the buckle on the converting plate. A number of attaching holes are formed on the converting plate by which the converting plate is securely attached to the upper surface of the lace-type skate.

2 Claims, 5 Drawing Sheets

MEANS FOR CONVERTING UNFINISHED PRODUCTS OF LACE-TYPE SKATES INTO BUCKLE-TYPE SKATES

BACKGROUND OF THE INVENTION

The present invention relates to a converting means which can be applied to an unfinished product of skates of lace type and thus converts the latter into buckle type.

FIGS. 5 and 6 of the drawings respectively show a lace-type skate 5 which has a plurality of lace holes 51 therein and a buckle-type skate 6 which has a plurality of flanges 61 thereon for installation of buckles 62. However, skate manufacturers have to build two different kinds of molds to proceed with various processing to finish the two different kinds of products. Consequently, the cost for the molds increases, not to mention difficulties in subsequent arrangements and managements of two respective processing procedures for two different kinds of unfinished products. Furthermore, another problem arises in the storage of unfinished-products of skates.

The problems encountered in manufacturing and management of unfinished products of skates are avoided by the present invention.

SUMMARY OF THE INVENTION

Accordingly, it is a primary object of the present invention to provide a converting means which can be applied to an unfinished product of a lace-type skate and thus converts the latter into a buckle-type skate. The converting means has an underside with a contour complimentary to that of an upper surface of the unfinished product of the lace-type skate. The converting means also has an upper side with a plurality of pairs of flanges in which each pair of flanges defines a space for installation of buckles.

It is another object of the present invention to provide a converting means by which a lace-type skate can be converted into a buckle-type skate, thereby eliminating the cost for manufacturing the mold for buckle-type skates and subsequent storage and management problems therefor.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
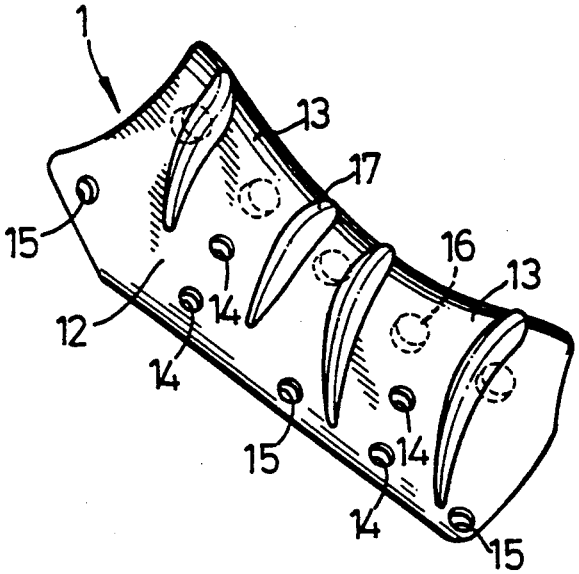
FIG. 1 is a schematic view showing an upper side of a converting means according to the present invention.
Figure 2:
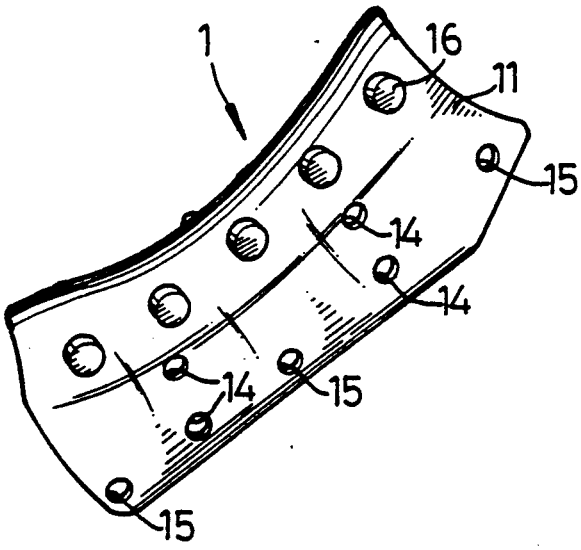
FIG. 2 is a schematic view showing an underside of the converting means of FIG. 1.
Figure 3:
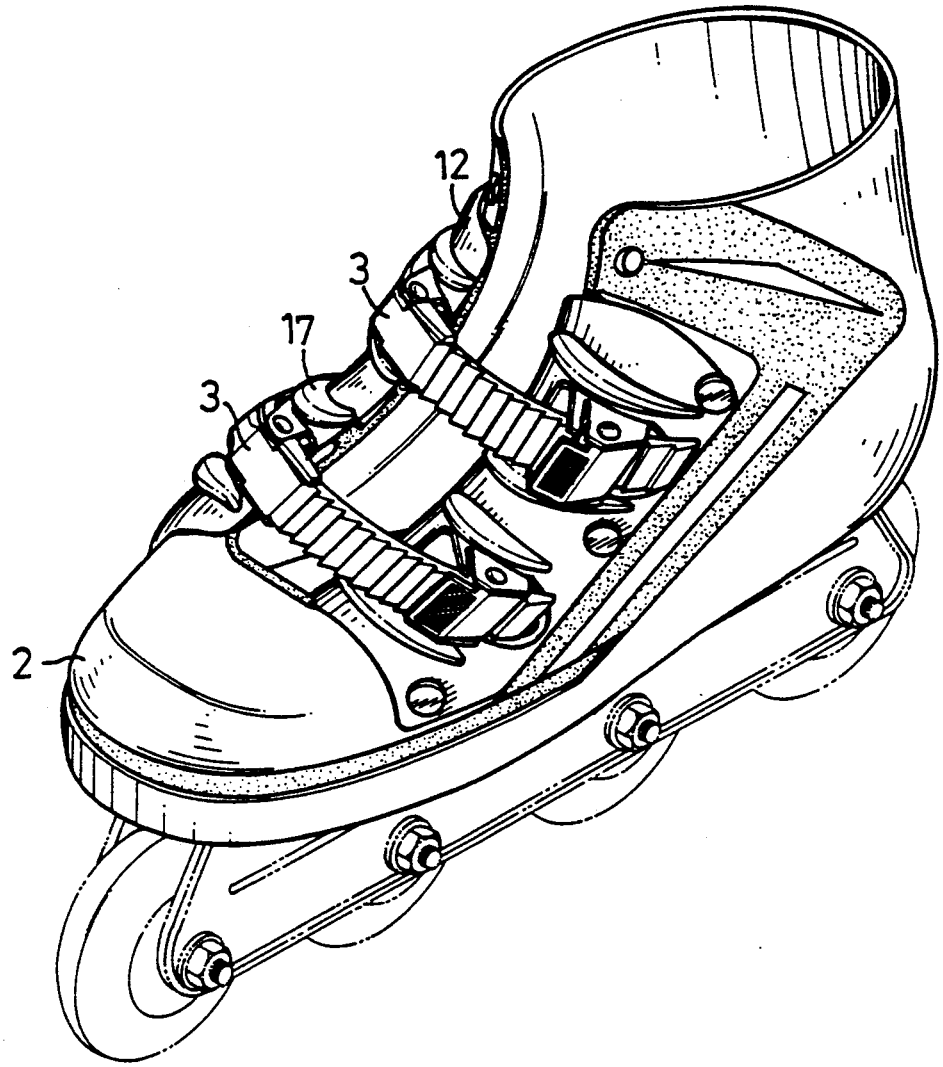
FIG. 3 is a perspective view of a roller skate of buckle type converted from a lace-type skate by means of the converting means of the present invention.
Figure 4:
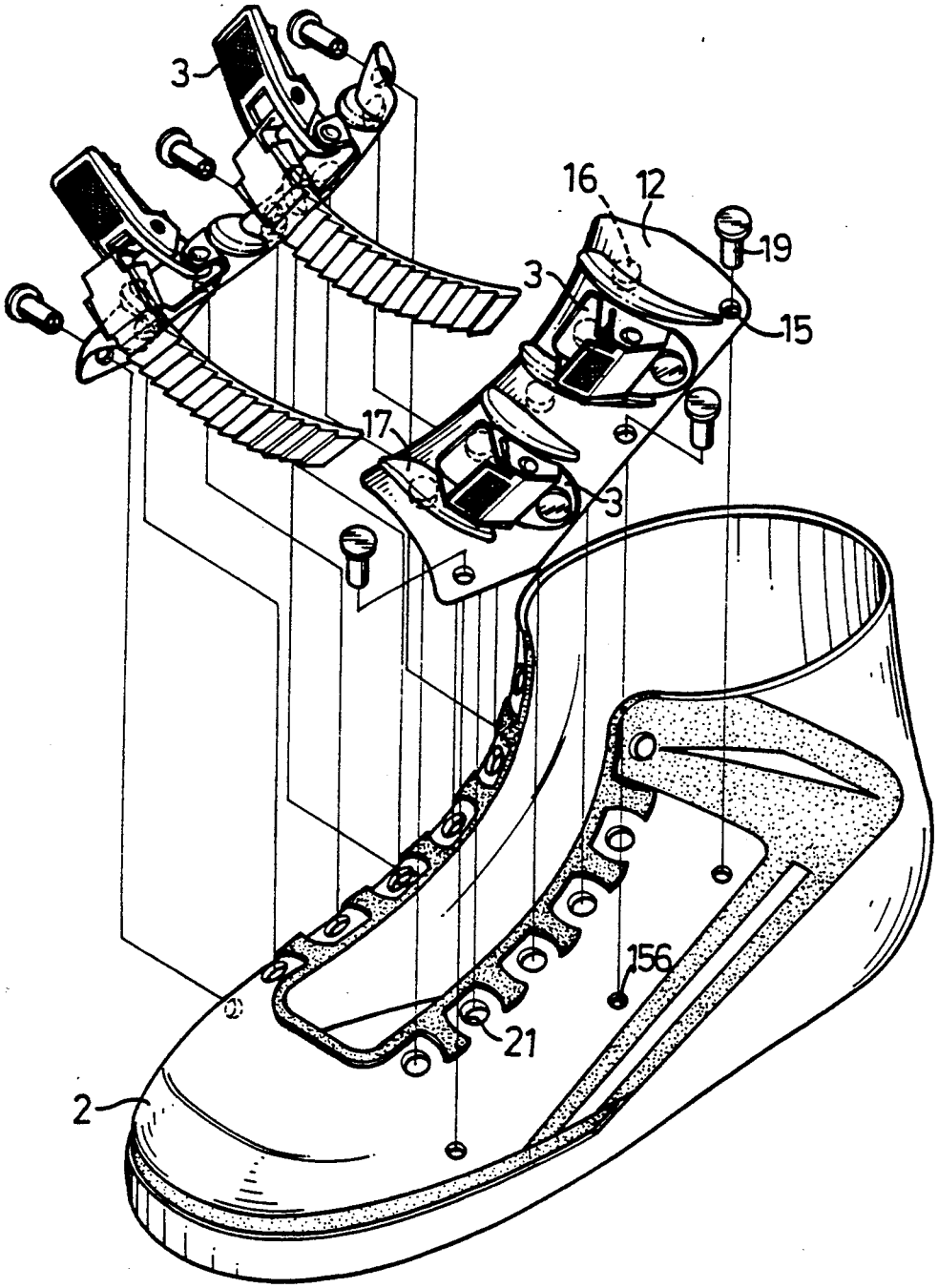
FIG. 4 is an exploded perspective view of the roller skate in FIG. 3, wherein the rollers are omitted for clarity.
Figure 5:
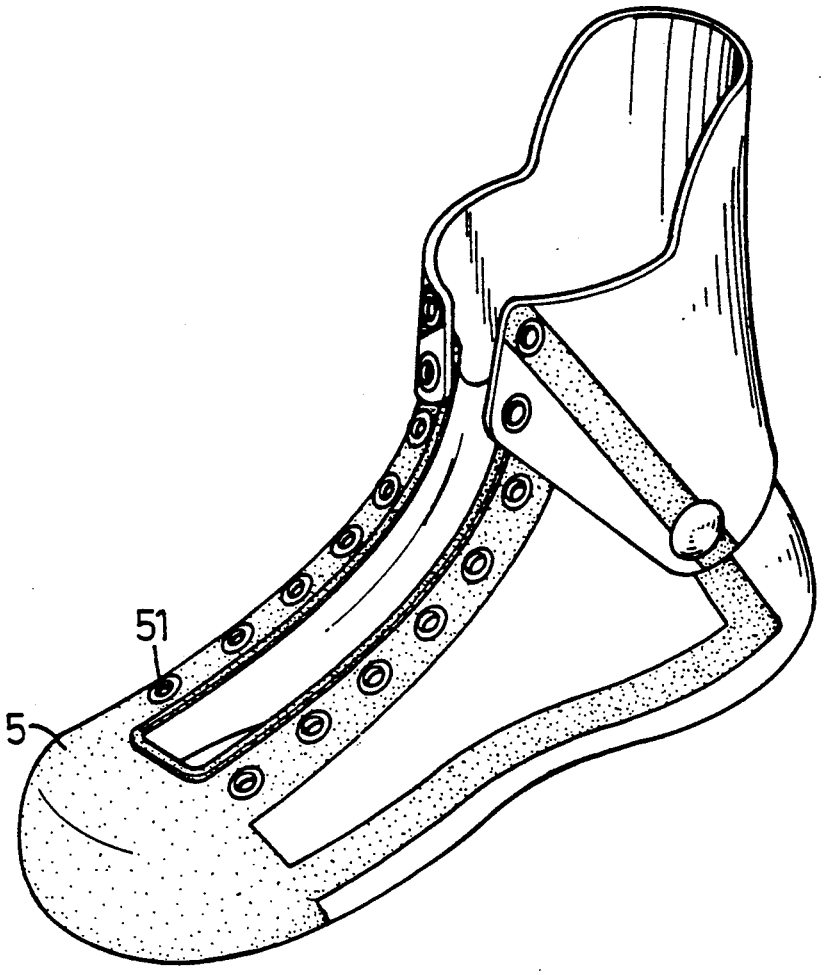
FIG.5 PRIOR ART
FIG. 5 shows a conventional lace-type skate.
Figure 6:
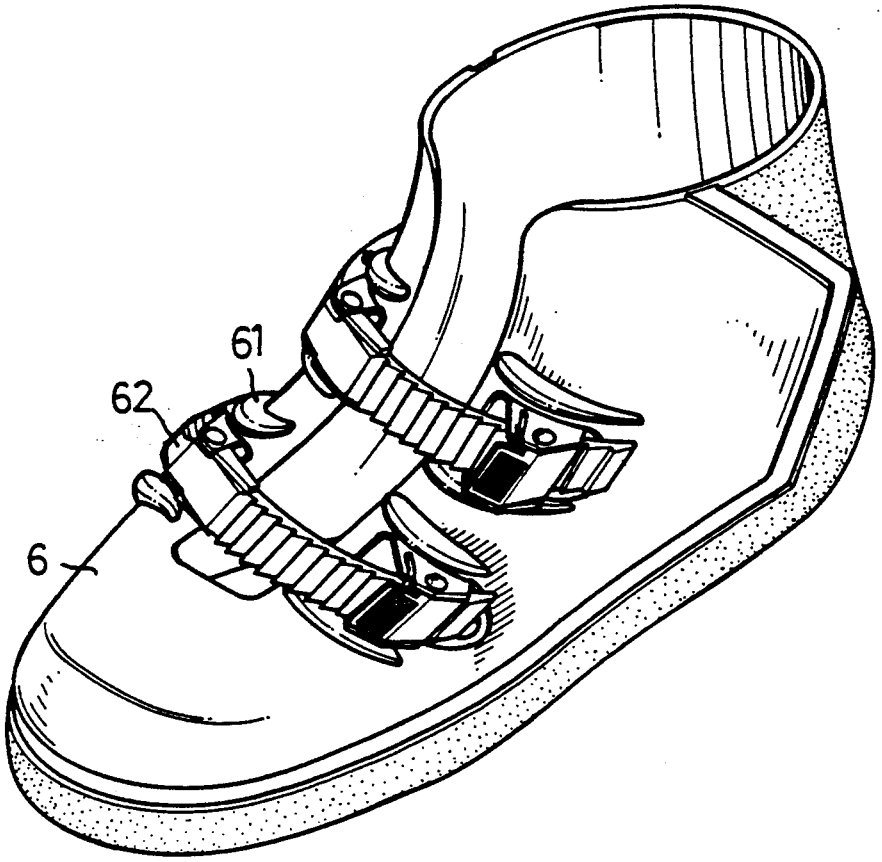
FIG. 6 PRIOR ART
FIG. 6 shows a conventional buckle-type skate.

Referring to FIGS. 1 through 4 of the drawings and initially to FIGS. 1 and 2, a converting means 1 according to the present invention includes an upper side 12 and an underside 11 with a contour complimentary to that of an upper surface of a lace-type skate 2 (see FIG. 4). A plurality of protrusions 16 are formed on the underside 11 of the converting means 1, corresponding to eyelets 21 of the lace-type skate 2. A plurality of pairs of flanges 17 (in this embodiment there are four flanges) are formed on the upper side 12 of the converting means 1, defining a space 13 between each pair of flanges for installing a buckle means 3. A plurality of mounting holes 14 are formed on the converting means 1 for securely mounting the buckle means 3 on the converting means 1. A plurality of attaching holes 15 are formed on the converting means 1 by which the converting means 1 is securely attached to the upper surface of the lace-type skate 2. The lace-type skate 2 has a corresponding number of attaching holes 156 thereon.

Referring to FIGS. 3 and 4, in this embodiment, the converting means 1 for converting an unfinished product of the lace-type skate 2 into an unfinished product of a buckle-type skate consists of two mirror-imaged converting plates respectively complimentary to left and right portions of the upper surface of the lace-type skate 2. The two converting plates are placed on the upper surface of the lace-type skate 2, with the protrusions 16 passing through the eyelets 21. Then, the converting plates are securely mounted on the skate 2 by using rivets 19 passing through the attaching holes 15 and 156. Thereafter, the buckle means 3 are mounted in the spaces 13 between the flanges 17 on the converting plates by passing rivets (not labeled) through the mounting holes 14. Consequently, the unfinished product of the lace-type skate 2 is successfully converted into a unfinished product of a buckle-type skate.

Although the invention has been explained in relation to its preferred embodiment, it is to be understood that many other possible modifications and variations can be made without departing the spirit and scope of the invention. For example, the converting means 1 can be securely mounted on the lace-type skate by other means, such as glue. Similarly, there are many other feasible means to mount the buckle means on the converting means. In addition, the converting means can be an integral plate instead of two separate plates. The scope of the invention can be defined by the annexed claims.

I claim:

1. A converting means for converting an unfinished product of a skate of lace-type into buckle-type comprising:

an underside with a contour complimentary to that of an upper surface of the lace-type skate, a plurality of protrusions being formed on said underside for engagement with eyelets of the lace-type skate;

an upper side with a plurality of pairs of flanges formed thereon defining a space between each said pair of flanges, said space adapted to receive a buckle means therein;

a plurality of mounting holes for securely mounting the buckle means on said converting means; and a plurality of attaching holes for securely attaching said converting means on the lace-type skate.

2. A device for converting an unfinished product of a lace-type skate to an unfinished product of a buckle-type skate, comprising:

a member having an upperside and an underside with a contour complimentary to that of an upper surface of the lace-type skate, a plurality of protrusions formed integrally on an extending from the underside of the member for engagement with eyelets in the lace-type skates;

a plurality of flanges formed on the upperside of the member and defining a plurality of spaces therebetween, each space being sized so as to receive a buckle means therein; and means defining a plurality of mounting holes in the member, for receiving means for securing the buckle means to the member; and means defining a plurality of attachment holes in the member for receiving means for securing the member to a lace-type skate.

* * * * *